US012392126B2

(12) United States Patent
Dezielle et al.

(10) Patent No.: US 12,392,126 B2
(45) Date of Patent: Aug. 19, 2025

(54) HANGER WITH REMOVABLE LEVELING MEMBER

(71) Applicant: OMG Building Products LLC, Agawam, MA (US)

(72) Inventors: Jonathan W. Dezielle, Agawam, MA (US); Mark J. Guthrie, West Springfield, MA (US); Logan Carlson, Wilbraham, MA (US); Timothy F. Gillis, Florence, MA (US); Mark A. Dicaire, Boylston, MA (US)

(73) Assignee: OMG Building Products LLC, Agawam, MA (US)

( * ) Notice: Subject to any disclaimer, the term of this patent is extended or adjusted under 35 U.S.C. 154(b) by 175 days.

(21) Appl. No.: 18/040,537

(22) PCT Filed: Aug. 4, 2021

(86) PCT No.: PCT/US2021/044573
§ 371 (c)(1),
(2) Date: Feb. 3, 2023

(87) PCT Pub. No.: WO2022/031867
PCT Pub. Date: Feb. 10, 2022

(65) Prior Publication Data

US 2023/0304277 A1 Sep. 28, 2023

Related U.S. Application Data

(60) Provisional application No. 63/062,022, filed on Aug. 6, 2020.

(51) Int. Cl.
*E04B 1/26* (2006.01)
*E04G 21/18* (2006.01)

(52) U.S. Cl.
CPC ..... *E04B 1/2612* (2013.01); *E04G 21/1841* (2013.01); *E04B 2001/2652* (2013.01)

(58) Field of Classification Search
CPC ..... E04B 1/2612; E04B 2001/2652; E04G 21/1841
See application file for complete search history.

(56) References Cited

U.S. PATENT DOCUMENTS 2,115,625 A * 4/1938 Fleshman ..... E04G 17/18 52/702
4,124,962 A * 11/1978 Lancelot, III ..... E04B 1/2612 52/702

(Continued)

FOREIGN PATENT DOCUMENTS

GB 2316103 A * 2/1998 ..... E04B 1/2612
GB 2396630 A 6/2004
WO WO-2022006364 A1 * 1/2022 ..... E04B 1/2612

OTHER PUBLICATIONS

International Search Report and Written Opinion mailed Nov. 3, 2021 for International Patent Application No. PCT/US2021/044573.

*Primary Examiner* — Jessie T Fonseca
(74) *Attorney, Agent, or Firm* — Alix, Yale & Ristas, LLP

(57) ABSTRACT

An adjustable hanger for attaching an elongate beam to a support member has abase member with opposite sides and a support web. A leveling member with a top panel is attachable to the base member in a vertically reciprocal engagement. The top panel includes a rear flange for supporting on a surface of a support member, whereupon the support web is parallel with the surface of the support member. The leveling member is movable relative to the base member to accommodate elongate beams having different height dimensions. Once the beam is attached to the (Continued)

support member via fasteners, the leveling member may be detached from the base member. The leveling member or base member may have cooperative posts or legs and slots to facilitate engagement between them. A breakable cuff in the base member may engage a post of the leveling member to allow reciprocation followed by detachment.

20 Claims, 8 Drawing Sheets

(56) References Cited

U.S. PATENT DOCUMENTS

| | | | | |
|---|---|---|---|---|
| 4,223,866 | A * | 9/1980 | Black | E04G 17/18 249/211 |
| 4,753,014 | A * | 6/1988 | Vrajich | G01B 3/30 33/613 |
| 4,947,616 | A * | 8/1990 | Sorton | E04B 1/2612 33/645 |
| 6,763,634 | B1 | 7/2004 | Thompson | |
| 7,665,253 | B1 * | 2/2010 | Thompson | E04B 1/2604 52/153 |
| 10,179,992 | B2 * | 1/2019 | Brekke | E04B 1/2612 |
| 11,773,582 | B2 * | 10/2023 | Dicaire | E04B 1/2612 52/704 |
| 2008/0172976 | A1 * | 7/2008 | Carney | E04B 5/12 52/702 |
| 2014/0182236 | A1 | 7/2014 | Doupe et al. | |
| 2015/0218832 | A1 * | 8/2015 | Peters | E04B 5/12 269/46 |
| 2018/0038094 | A1 * | 2/2018 | Brekke | E04B 1/2612 |
| 2022/0002989 | A1 * | 1/2022 | Dicaire | E04B 1/2612 |

* cited by examiner

HANGER WITH REMOVABLE LEVELING MEMBER

BACKGROUND

This disclosure relates generally to the field of building construction connectors, more particularly to a hanger for supporting and attaching an elongate beam, such as a joist, relative to a building support member, and more particularly a hanger that is height adjustable and has a leveling member for leveling the hanger relative to the building support member that is removable.

In construction and building fields, hangers are common for assisting in the connection of one building member to another, such as an elongate beam (i.e., joist) to a rear support member (i.e., ledger). Hangers are often formed of metal, such as steel and include numerous sides and surfaces used for attaching to a support member and joist, and holding and supporting the beam. Some hangers may be formed of other rigid durable materials, such as molded plastics.

One common type of beam is a deck or floor joist used as a substructure to support an overlying deck or floor structure. Deck joists can attach to an end support member, usually on a side of a building, and extend substantially perpendicular therefrom at a height substantially parallel to the other joists. A joist hanger is used as an intermediate member to attach the joists to the support member. Joist hangers are usually formed of a single piece of steel with opposite sides and a bottom web for holding and supporting a joist from underneath, and rear and/or top flange elements for attaching to a support member.

One common problem associated with joist hangers is that they are cumbersome and time consuming to install, require many meticulous measurements and it can be difficult to level a joist given variances in dimension. Lumber of all types, including decking materials, is not always sized completely accurately and consistent. The height of joists can thus vary from one another by as much as 0.5 inches simply due to common production deviations or shrinkage of the wooden materials due to drying. This phenomenon can cause inconsistencies and integrity issues with building structures.

Thus, it would be useful to provide a hanger with capabilities to improve upon these common issues, including a mechanism to adjust the height of a beam (joist) that it supports and attaches to a building support member.

SUMMARY

In one embodiment, a hanger for attaching an elongate beam to a support member includes a base member and a leveling member. The base member comprises a left side laterally spaced from a right side with a support web extending therebetween. The support web is substantially perpendicular to the left side panel and right side panel. The leveling member has an upper platform that is substantially parallel to the support web when engaged to the base member in a vertically movable connection. The base member and leveling member are vertically movable relative to one another with the upper platform supported on a surface of the support member. The leveling member is optionally detachable from the base member.

In another embodiment, a hanger for attaching an elongate beam to a support member comprises a base member and a leveling member. The base member comprises a flat left side panel laterally spaced from a parallel flat right side panel with a substantially perpendicular support web extending therebetween. The support web defines a flat inner surface. The leveling member has an upper platform with a flat inner surface substantially parallel to the flat inner surface of the support web. The base member further includes one or more vertically extending slots and the leveling member includes one or more posts extending downward from the upper platform. Each of the one or more posts is received within one of the one or more slots extending vertically therethrough to connect the leveling member to the base member in a vertically movable relationship.

In yet another embodiment, a hanger for attaching an elongate beam to a support member comprises a base member and a leveling member. The base member has a flat left panel and a parallel flat right panel with a flat web extending perpendicularly therebetween. Each of the left panel and right panel defines an opening. The leveling member comprises a top panel with rearwardly extending flange. The flange is substantially parallel to the web and extends rearwardly from a rear edge of the left panel and a rear edge of the right panel. A left leg member extending downwardly from one side of the top panel and a right leg member extending downwardly from an opposite side of the top panel. The left leg member is receiving in the opening in the left side panel and the right leg member is received in the opening in the right side member to engage the leveling member with the base member in a reciprocal relationship. The leveling member is detachable from the base member.

DETAILED DESCRIPTION

Figure 1:
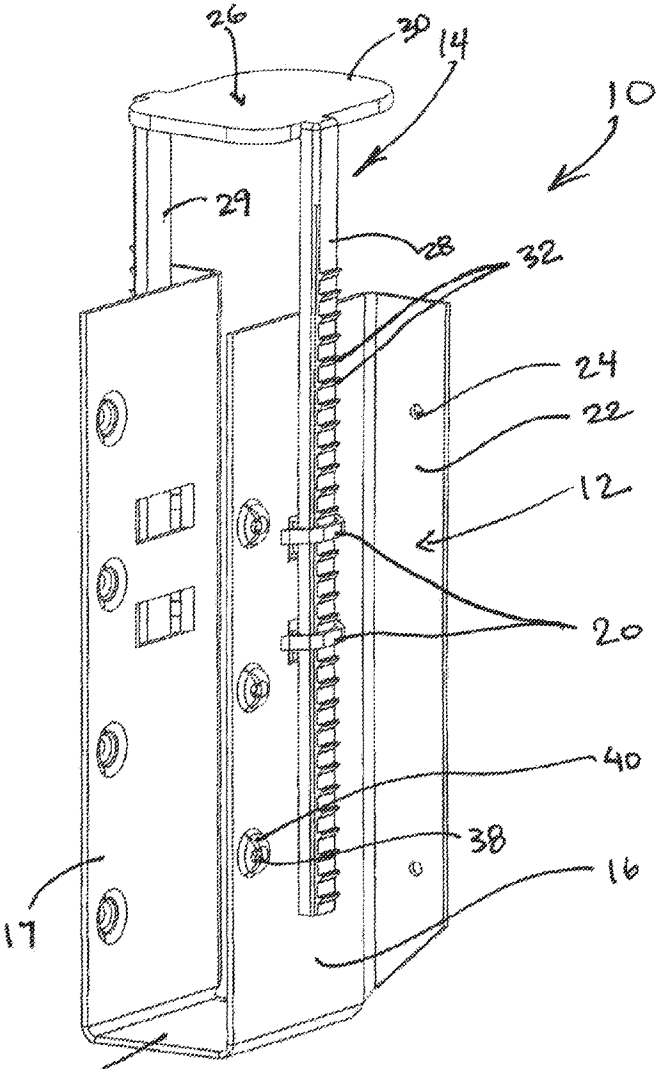
FIG. 1 shows a hanger with removable leveling member according to the disclosure from a front perspective view.

Among the benefits and improvements disclosed herein, other objects and advantages of the disclosed embodiments will become apparent from the following wherein like numerals represent like parts throughout the several figures. Detailed embodiments of a height variable hanger with removable leveling member are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on".

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Additionally, the embodiments described herein are done so with primary reference to a preferred embodiment that is a joist hanger for attaching a joist beam to a rear ledger. However, it is understood that the embodiments are not limited as such, and the inventive concepts embodied in the disclosed embodiments apply to a wide variety of hangers or brackets for use in attaching elongate building support members or beams to another support member. Herein, the term "joist" is synonymous with and shall encompass a beam or elongate building member. Likewise, the term "ledger" is synonymous with and shall encompass any building support member or structure to which a beam may be attached.

With reference to the drawings wherein like numerals represent like parts throughout the figures, a hanger 10 is depicted that most generally includes a support base member 12 and a removable leveling member 14. The base 12 comprises a pair of spaced apart sides 16 and 17 with a bottom joist support web 18. In the depicted embodiment, the sides 16/17 are generally flat parallel panels with each side comprising one or more cuffs 20 that extend outward from the outer side surface to define a vertically extending slot. The base 12 may include additional rear flanges 22/23 with holes 24 for receiving fasteners to attach the base 12 to a building support (i.e., ledger L). The depicted attachment flanges 22/23 extend outwardly from and substantially perpendicular to the sides 16/17, however, embodiments exist with inwardly extending flanges for attachment behind the joist J or other beam.

The leveling member 14 generally comprises an upper flat platform 26 with a pair of posts or legs 28/29 extending downward therefrom on each lateral side. The platform defines a support flange 30 that extends rearwardly to an edge that is rearwardly positioned relative to the rear edges of the side flanges 22/23 when the leveling member 14 and base 12 are attached. As shown, each of the slots defined by the cuffs 20 is sized and shaped to receive one of the posts 28/29 extending downwardly. Each of the posts 28/29 carries a series of vertically spaced teeth 32 preferably with an angled bottom surface to aid in passing the posts through the cuff slots. As shown, preferably, adjacent teeth 32 include sufficient clearance between them to accommodate one of the cuffs. When the leveling member 14 and base 12 are engaged, the top platform and rear flange are substantially parallel to the inner surface of the support web.

Figure 2:
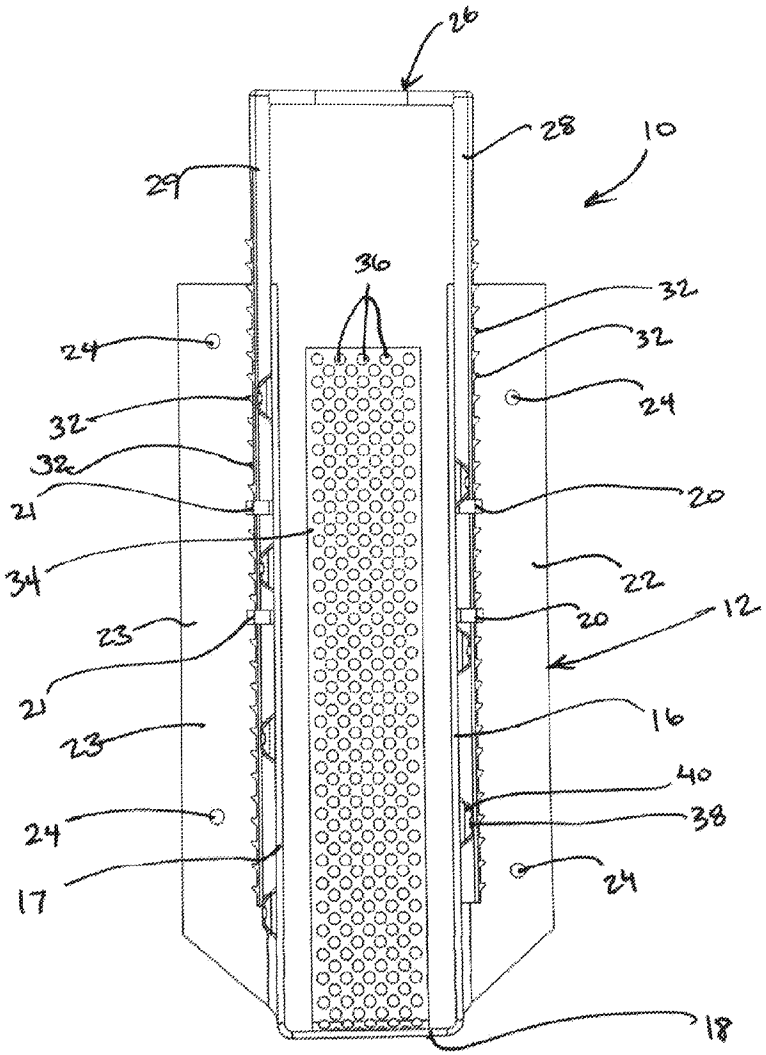
FIG. 2 is a front elevation view of the hanger of FIG. 1.
Figure 3:
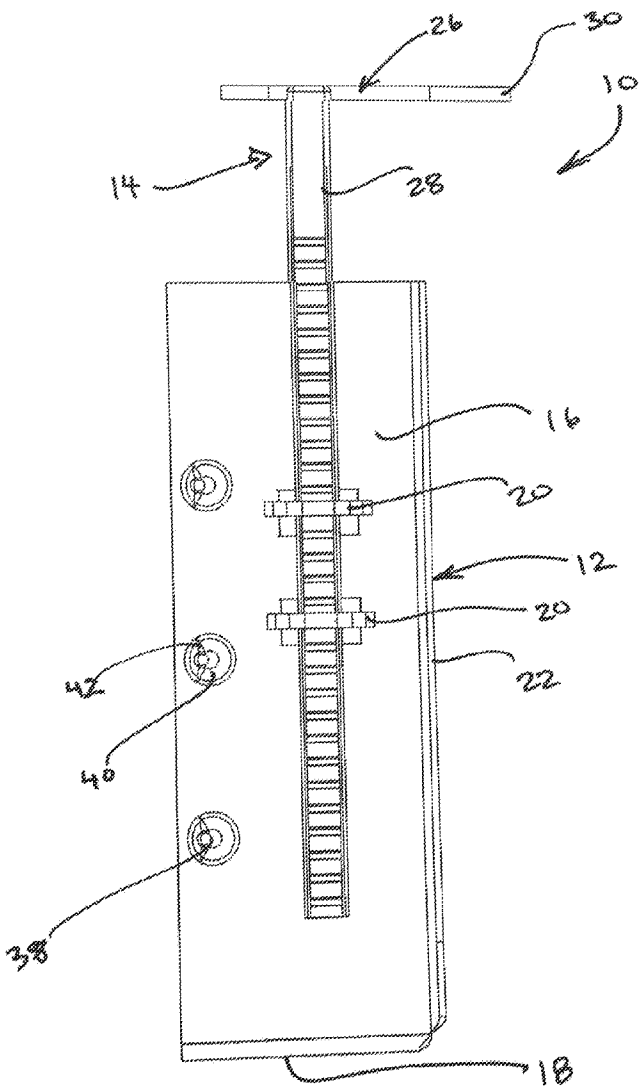
FIG. 3 is a side elevation view of the hanger of FIG. 1.
Figure 4:
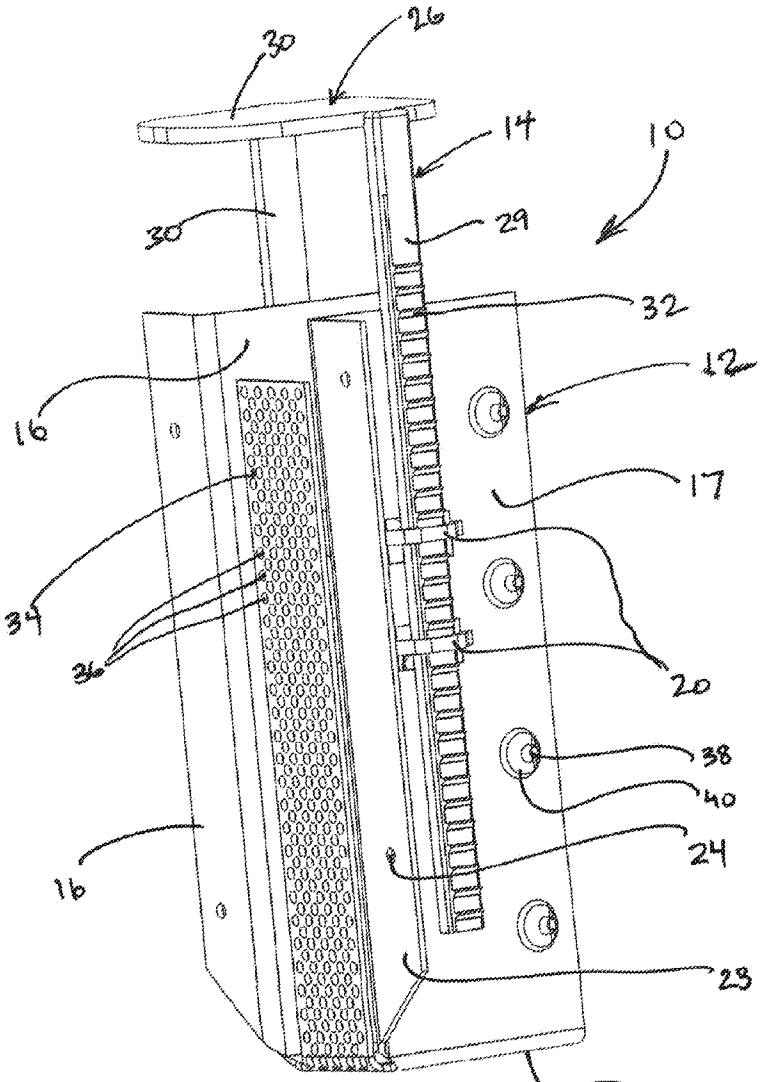
FIG. 4 is a rear perspective view of the hanger of FIG. 1.

With reference to FIGS. 2 and 4, the base 12 may optionally include a rear panel 34 that defines a plurality of holes 36. The rear panel 34 is preferably formed from a bend at the rear edge of the joist support web 18 and extends upward substantially perpendicular thereto. The rear panel 34 is preferably substantially parallel to and coplanar with the side flanges 22/23, and substantially perpendicular to the side panels 16/17. Each of the holes in the rear panel 34 and side flanges 22/23 is sized to receive a fastener for attachment of the base 12 to a ledger L. It can be said that the side panels 16/17 and web 18, and the rear panel 34, when present, combine to define a channel for receipt of an elongate beam or joist to be supported on the web 18 and sandwiched between the side panels 16/17.

As shown, the side panels 16/17 also define a plurality of holes 38 for accommodating fasteners driven at an oblique angle for attaching a joist J to the ledger L. In the depicted embodiment, the side panel holes 38 are at least partially circumscribed with a raised support surface 40. The raised support surfaces 40 may include one or more relief notches 42 and are generally configured to assist alignment of a driving tool by providing an abutment surface for the nose of the tool. The offset raised surfaces 40 additionally act to help maintain integrity of the side panels, 16 and 17, during and after driving of a fastener. Typically, the polymeric panels can deform under the pressure of the fastener head when driven with significant force from a power driving tool. The side panel holes 40 are offset vertically from one another and preferably extend obliquely through a respective side panel at an angle specifically configured to assist in creating a "toenail" connection between the base 12, joist J and ledger L. "Toenailing" or creating a "toenail" connection is a common type of attachment technique in the building industry whereby multiple fasteners are driven obliquely through opposite sides of the joist J and into the ledger L. The holes 40 in the left panel 17 are vertically offset from the holes 40 in the right panel 16 to allow the fasteners to be driven through the rear of the joist J without obstructing one another.

Additionally, the embodiments of the hanger 10 can include one or more boss covers at an outer portion of any of the toenail holes 40 consistent with those disclosed in co-owned U.S. patent application Ser. No. 17/364,950 and International Patent Application No. PCT/US2021/40033. Each boss cover defines a relatively smaller opening than the primary opening of the obliquely extending toenail hole and is configured so that it breaks away (at least partially) from the main body of the hanger at some point as a screw is driven further through the hole and eventually into the joist and ledger, yielding an abutment between the head of the screw and the outside surface of the hanger. In this manner, the screws are driven in a repeatably precise angle and position.

In the depicted embodiment, the base 12 and leveling member 14 are both formed of a molded polymer. However other embodiments exist wherein one or both are made from a different material such as metal. The other hardware, including fasteners, are typically formed of steel which may be treated in any known manner to improve strength, hardness and corrosion resistive properties (i.e., heat treating, coating, etc.). The hardware is not limited in dimension.

FIGS. 5-8 are exemplary of a typical installation of a joist J or beam using the hanger 10 and help illustrate the elements, relationships and typical operation within the hanger 10.

Figure 5:
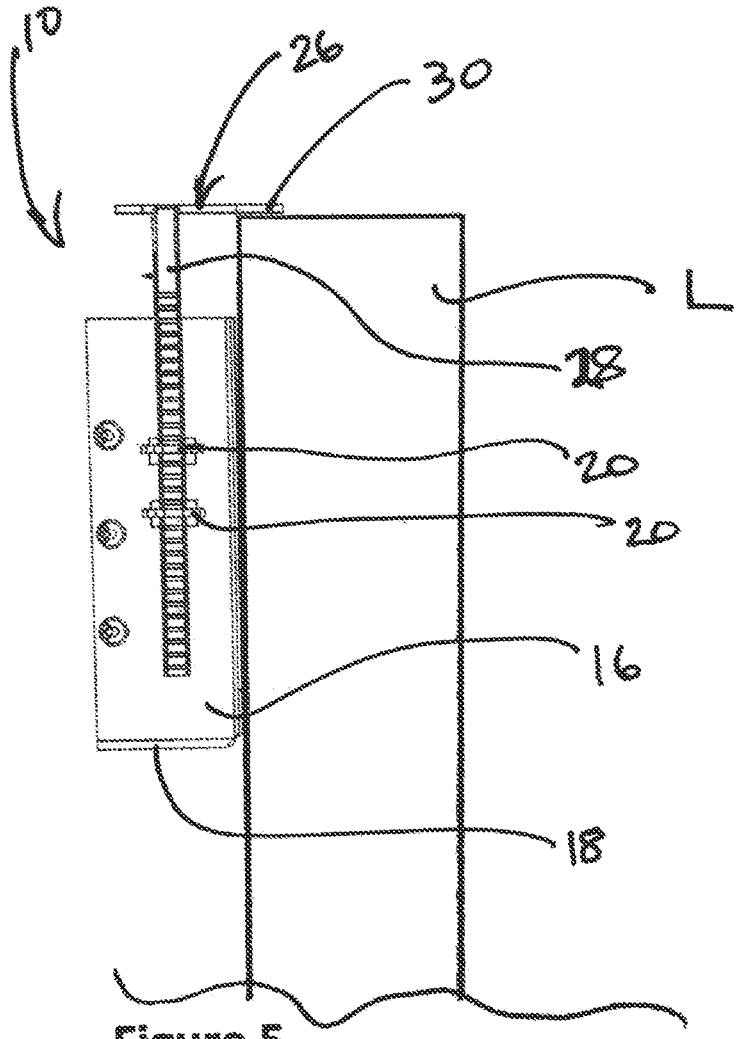
FIG. 5 is a side elevation view of the hanger being attached to a ledger.
Figure 6:
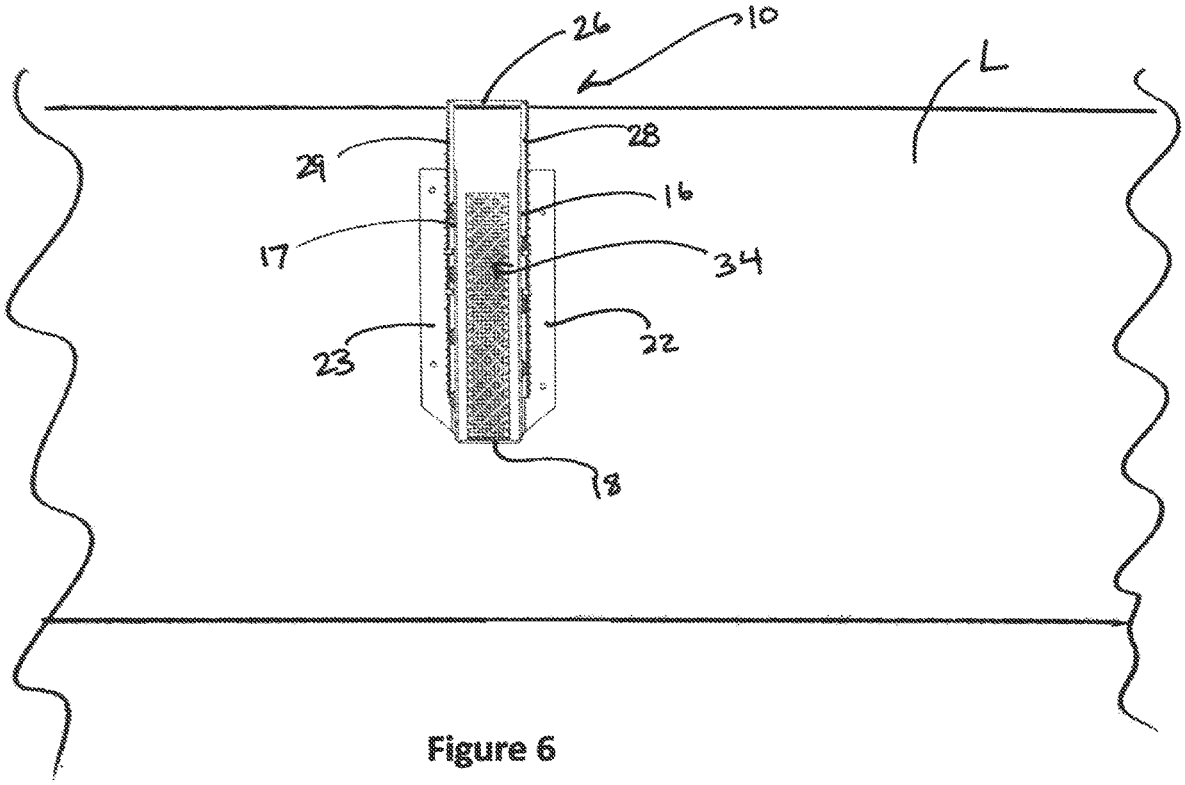
FIG. 6 is a front elevation view of the hanger being attached to a ledger.

FIGS. 5 and 6 illustrate a first step. The hanger 10 is placed against the front surface of a ledger L with the support flange 30 resting on the top surface of the ledger, which ensures that base 12 (more specifically, the web 18 of the base) is level. An installer can subsequently adjust the height of the base 12 by sliding it downward relative to the leveling member 14. As the base 12 is moved downward, the posts 28/29 pass through the cuffs 20. The post teeth 32 include a lower ramp surface to assist in allowing the base 12 to travel downward relative to the leveling member. Since the cuffs 20 are formed from molded plastic, they offer a small degree of outward flexibility to help permit the teeth 32 to pass downward during installation.

Once the base 12 is positioned at the proper height for accommodating the joist J and positioning the joist at the desired height, the base 12 is attached to the ledger L via fasteners driven obliquely through holes 24 in the side flanges 22/23 and optionally through one or more of the holes 36 in the rear panel 34.

Figure 7:
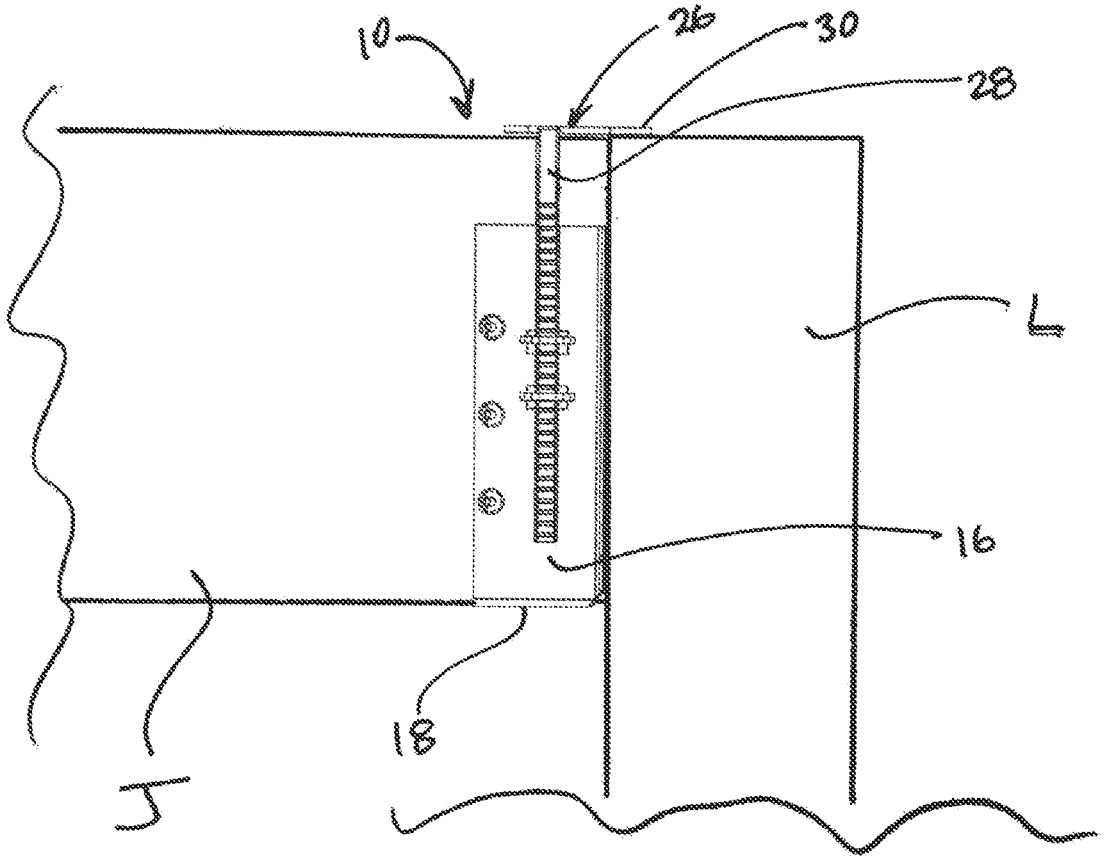
FIG. 7 is a side elevation view of the hanger attached to the ledger supporting a joist prior to removal of the leveling member.

With reference to FIG. 7, a joist J is inserted between the upper platform 26 and joist support web 18. The parallel relationship between the support web 18 and upper platform 26, with the support flange 30 flat atop the ledger L ensures that the joist J remains level. Fasteners are then driven obliquely through the side holes 38 and rear of the joist J and into the ledger L to secure the joist with a toenail connection (note: fasteners not shown in the Figures).

Figure 8:
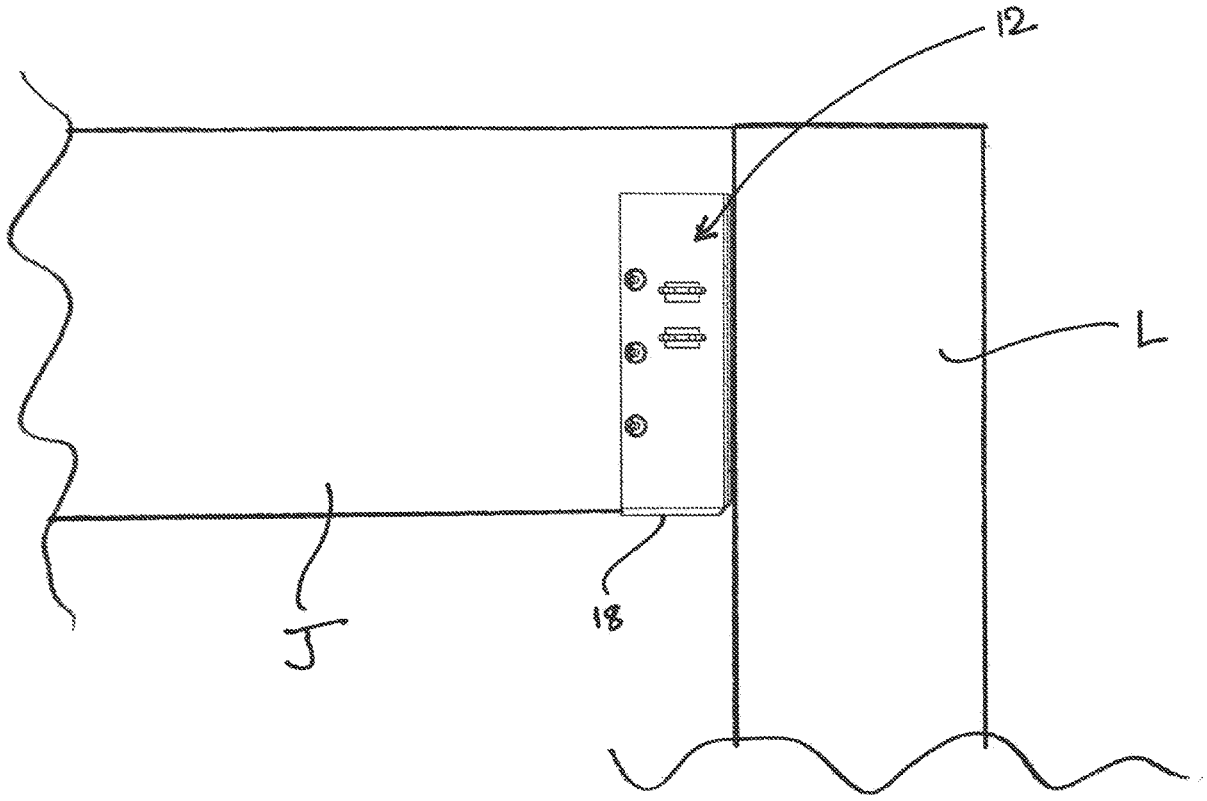
FIG. 8 shows the hanger supporting a joist attached to a ledger.

With reference to FIG. 8, once the joist J is attached to the ledger L, the leveling member 14 is removed, yielding a completely level joist J at the precisely desired height. The leveling member 14 can be removed by one or more of cutting, breaking, or bending the cuffs 20 to allow disengagement of the teeth 32 and legs. Alternatively, the legs 28/29 may be cut or broken to remove the leveling member. Additional joists may be installed in the same manner. The hanger 10 ensures that all joists in a given structure are installed consistently level with one another and the ledger, regardless of minor deviations in dimension that may exist among the joists.

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A hanger for attaching an elongate beam to a support member, comprising:

a base member comprising a left side laterally spaced from a right side with a support web extending therebetween, the support web being substantially perpendicular to the left side and right side; and a leveling member having an upper platform that is substantially parallel to the support web when engaged to the base member in a vertically movable connection, wherein the base member and the leveling member are vertically movable relative to one another with the upper platform supported on a surface of the support member, the leveling member is detachable from the base member, the leveling member comprises at least one post extending downward from the upper platform, and the base member comprises at least one cuff that defines a vertically open slot that receives a post of the at least one post in a vertically slidable relationship, and the post of the at least one post includes a series of vertically spaced apart teeth that engage a cuff in a ratchet engagement.

2. The hanger of claim 1, wherein the base member and the leveling member are engaged via a cooperative and slidable leg in slot relationship.

3. The hanger of claim 1, wherein the leveling member is detachable from the base member via breaking or bending the respective cuffs to allow disengagement of the respective post.

4. A hanger for attaching an elongate beam to a support member, comprising:

a base member comprising a left side laterally spaced from a right side with a support web extending therebetween, the support web being substantially perpendicular to the left side and right side; and a leveling member having an upper platform that is substantially parallel to the support web when engaged to the base member in a vertically movable connection, wherein the base member and the leveling member are vertically movable relative to one another with the upper platform supported on a surface of the support member, the leveling member is detachable from the base member, and the upper platform defines a rear flange that extends rearwardly past a rear edge of the left side and a rear edge of the right side configured to rest on a top edge of the base member.

5. The hanger of claim 4, wherein the leveling member comprises at least one post extending downward from the upper platform, and the base member engages the at least one post.

6. The hanger of claim 5, wherein the base member comprises at least one cuff that defines a vertically open slot that receives a post of the at least one post in a vertically slidable relationship.

7. The hanger of claim 6, wherein the post of the at least one post includes a series of vertically spaced apart teeth that engage a cuff in a ratchet engagement.

8. The hanger of claim 4, wherein the base member and leveling member are formed as molded plastic parts.

9. A hanger for attaching an elongate beam to a support member, comprising:

a base member comprising a left side laterally spaced from a right side with a support web extending therebetween, the support web being substantially perpendicular to the left side and right side; and a leveling member having an upper platform that is substantially parallel to the support web when engaged to the base member in a vertically movable connection, wherein the base member and the leveling member are vertically movable relative to one another with the upper platform supported on a surface of the support member, the leveling member is detachable from the base member, and the base member comprises one or more rear flanges perpendicular to the left side and right side, each rear flange defining one or more holes for receipt of a fastener to attach the base member to the support member.

10. The hanger of claim 9, wherein the leveling member comprises a post extending downwardly from the upper platform on opposite sides thereof, each downwardly extending post being configured to engage with one of the left side and the right side.

11. The hanger of claim 10, wherein each of the left side and the right side includes a passthrough slot for receipt of one of the posts.

12. The hanger of claim 11, wherein the leveling member is detachable from the base member via disengagement of the posts from the respective passthrough slot.

13. The hanger of claim 12, wherein each of the pass-through slots is formed via a cuff extending away from an inner or outer surface of the left side and the right side.

14. The hanger of claim 13, wherein the leveling member is detachable from the base member via breaking or bending the respective cuffs to allow disengagement of the respective post.

15. The hanger of claim 11, wherein the base member and leveling member are formed from a plastic material.

16. A hanger for attaching an elongate beam to a support member, comprising:

a base member comprising a flat left side panel laterally spaced from a parallel flat right side panel with a substantially perpendicular support web extending therebetween, the support web defining a flat inner surface; and a leveling member having an upper platform with a flat inner surface substantially parallel to the flat inner surface of the support web, wherein the base member includes one or more vertically extending slots and the leveling member includes one or more posts extending downward from the upper platform, and each of the one or more posts is received within one of the at least one of the one or more vertically extending slots extending vertically therethrough to connect the leveling member to the base member in a vertically movable relationship, each of the one or more posts includes a plurality of spaced apart teeth, and adjacent teeth of the plurality of spaced apart teeth are configured to trap a portion of the base member with one of the one or more vertically extending slots positioned between said adjacent teeth.

17. The hanger of claim 16, wherein each of the one or more vertically extending slots is defined by a cuff in the left side panel or the right side panel.

18. The hanger of claim 17, wherein the leveling member is detachable from the base member by breaking the cuffs to disengage the vertically extending posts.

19. The hanger of claim 16, wherein the leveling member and the base member are both formed of a plastic material.

20. A hanger for attaching an elongate beam to a support member, comprising:

a base member with a flat left panel and a parallel flat right panel with a flat web extending perpendicularly therebetween, each of the left panel and the right panel defining an opening; and a leveling member comprising a top panel with rearwardly extending flange, the flange being substantially parallel to the web and extending rearwardly from a rear edge of the left panel and a rear edge of the right panel, a left leg member extending downwardly from one side of the top panel and a right leg member extending downwardly from an opposite side of the top panel, wherein the left leg member is received in the opening in the left side panel and the right leg member is received in the opening in the right side member to engage the leveling member with the base member in a reciprocal relationship, and the leveling member is detachable from the base member.

* * * * *